US007204275B1

(12) United States Patent
Contreras et al.

(10) Patent No.: US 7,204,275 B1
(45) Date of Patent: Apr. 17, 2007

(54) AUTOMATIC LAUNDRY TIE-OUT STATION

(76) Inventors: Luis O. Contreras, 6209 E. Rocking Horse Way, Orange, CA (US) 92869; Jack L. Hoffa, 512 Juniper St., Brea, CA (US) 92821

( * ) Notice: Subject to any disclaimer, the term of this patent is extended or adjusted under 35 U.S.C. 154(b) by 0 days.

(21) Appl. No.: 11/399,662

(22) Filed: Apr. 7, 2006

Related U.S. Application Data

(63) Continuation-in-part of application No. 11/202,122, filed on Aug. 12, 2005.

(51) Int. Cl.
*B65B 13/02* (2006.01)
*B65B 13/28* (2006.01)

(52) U.S. Cl. ..... 140/93 A; 100/18; 100/31

(58) Field of Classification Search ..... 140/93 A, 140/93.6; 100/8, 18, 31; 53/138.6, 138.8, 53/583

See application file for complete search history.

(56) References Cited

U.S. PATENT DOCUMENTS 4,054,160 A 10/1977 Knudsen
4,940,174 A 7/1990 Parker
5,238,122 A 8/1993 Hart
5,687,851 A 11/1997 Schonenberger
6,050,421 A 4/2000 Hansen
6,928,788 B1 * 8/2005 Lai ..... 53/138.8

* cited by examiner

*Primary Examiner*—Lowell A. Larson
*Assistant Examiner*—Jimmy Nguyen
(74) *Attorney, Agent, or Firm*—Gordon K. Anderson

(57) ABSTRACT

An existing tying machine (20) is modified by the addition of components to produce a self contained automatic laundry tie-out station (210). The components for the modification include a linear slide support yoke frame (22), attached on top of the component mounting platform (24) having a pneumatic linear slide unit (34) mounted on top. A hanger slide shaft assembly (220 or 220*a*) is attached to the linear slide unit which retains a selected group of hangers with laundered clothing (36'). Gravity conveyer feed lines are aligned with the hanger slide shaft (230) and a pneumatic system operates the slide unit with controls integrated into the tying machines existing electrical system. The hangers are drawn into the tying machine where they are bunched together and bound with a twist tie and then returned to the gravity laundry conveyer system. After the tying is completed a remote signal releases the bound hangers.

20 Claims, 11 Drawing Sheets

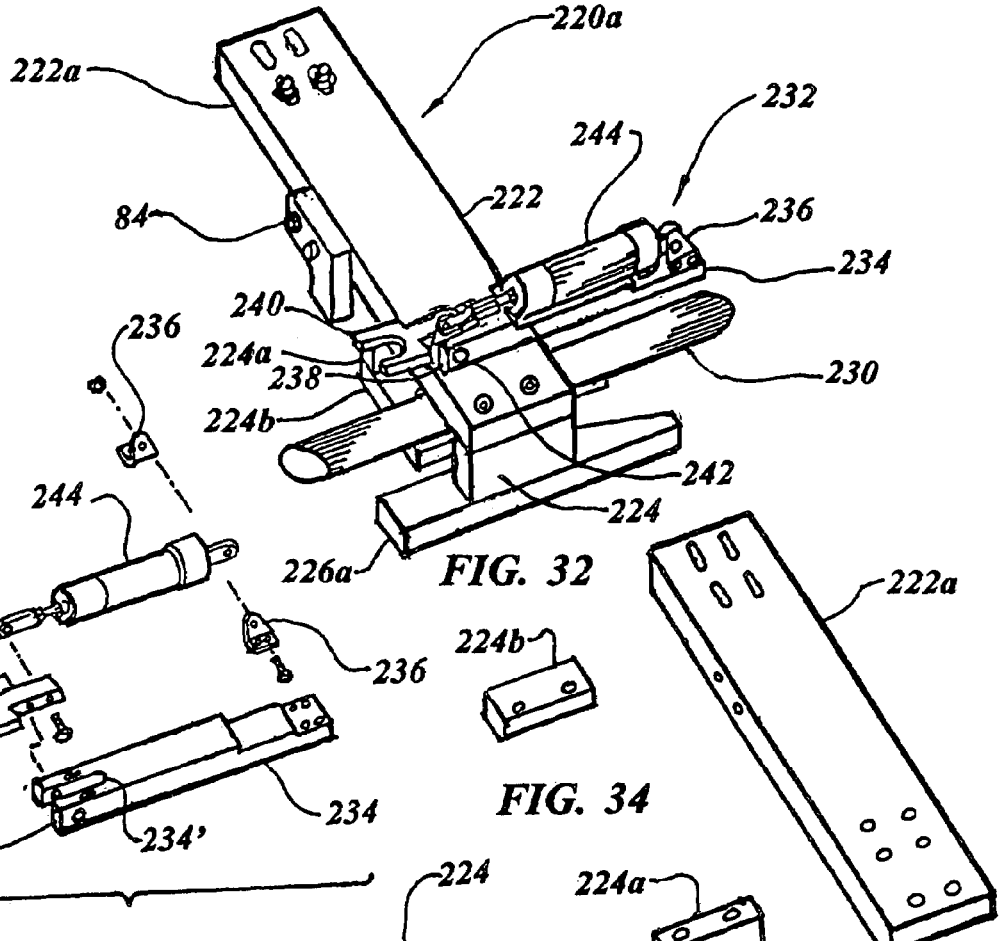
FIG. 32
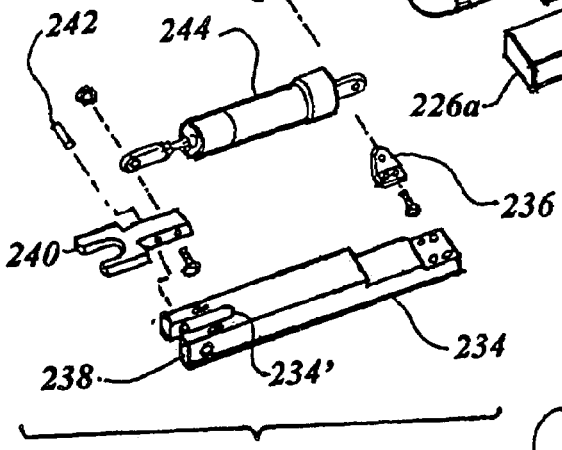
FIG. 33
FIG. 34
FIG. 37
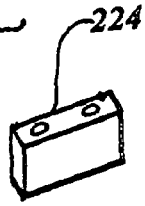
FIG. 35
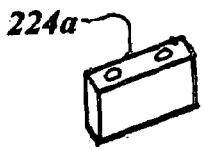
FIG. 36
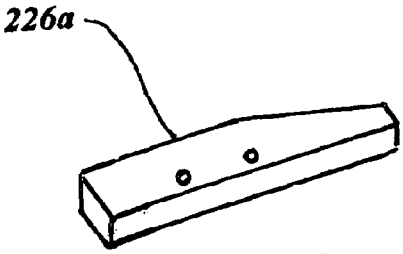
FIG. 38
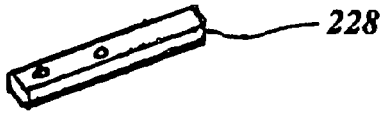
FIG. 39
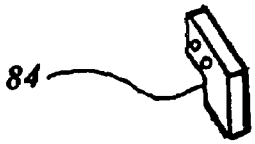
FIG. 40
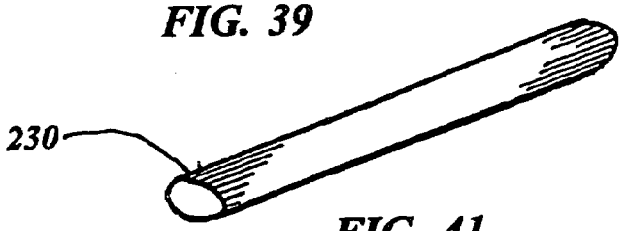
FIG. 41

AUTOMATIC LAUNDRY TIE-OUT STATION

CROSS REFERENCE TO RELATED APPLICATION

This application is a continuation-in-part of application Ser. No. 11/202,122 filed Aug. 12, 2005.

TECHNICAL FIELD

The present invention relates to tying machines in general. More specifically to an improvement in an existing tying machine which adds the components to produce an automatic laundry tie-out station for tying together a selected group of hangers on a laundry conveyer system.

BACKGROUND ART

Previously, many types of systems have been used in endeavoring to provide a laundry tie-out station to sort and tie together a selected group of laundry articles by connecting the hangers with a twist tie. Some prior art has developed systems that are very complex and sort and tie automatically while others simply use an existing conveyor system and manually sort the items by hand and attach them together with a conventional tying machine.

The prior art listed below did not disclose patents that possess any of the novelty of the instant invention; however the following U.S. patents are considered related:

| U.S. Pat. No. | Inventor | Issue Date |
|---|---|---|
| 4,054,160 | Knudsen | Oct. 18, 1977 |
| 4,940,174 | Parker | Jul. 10, 1990 |
| 5,238,122 | Hart | Aug. 24, 1993 |
| 5,687,851 | Schonenberger | Nov. 18, 1997 |
| 6,050,421 | Hansen | Apr. 18, 2000 |

Knudsen in U.S. Pat. No. 4,054,160 is for the tying machine in which the improvement is directed. The improvement adds the capabilities of incorporating equipment converting the machine into a tie-out station which ties a bundle of hangers together that are hanging on a conveyer rail.

U.S. Pat. No. 4,940,174 issued to Parker teaches a garment supporting system in which a garment hanger, having an aperture in a hook like neck, is employed in combination with an elongated flexible tie. The tie has a less flexible segment located along its length and a gripping ring located at one end of the tie. A ring is located on the end opposite of the flexible segment permitting transporting a number of garments in a controlled manner.

Hart, in U.S. Pat. No. 5,238,122 discloses a method and apparatus for sorting garments of different types and sizes. The garments are sorted according to different selection criteria and put together into chosen delivery groups. Sorting is accomplished in two steps first in pre-groups and second containing a specific size and type with all other groups combined, Schonenberger in U.S. Pat. No. 5,687,851 teaches a method of sorting articles in groups in a conveyer system. A first conveyer circle with an identification source recognizes predetermined number of articles individually. Independent of the loaded state of the first circle, a second conveyer circle sorts the balance as soon as the first sorting step has been identified.

U.S. Pat. No. 6,050,421 issued to Hansen is for an automated laundry sorting system with finished items on hangers tagged with electronic identification devices allowing sorting into predetermined groups. The improvement includes an automatic joining apparatus for separating the groups from each other and then physically joining them together with a twist tie machine. The groups representing a single faction such as garments belonging to a particular customer.

DISCLOSURE IF THE INVENTION

A common method used by smaller laundry's when it is required to batch a group of garments according to the customer or individual is to hand select the garments that are already on hangers and hand carry them to a tying machine and attach the group together at the twisted portion of the wire hanger with a twist tie.

This manual procedure described above is very labor intensive. The previous application filed by the inventor overcomes this problem saving labor and increasing production by using a tying machine that has the capabilities of not only accomplishing the tying procedure but acting as a tie-out station actually drawing the selected group of hangers containing laundered clothing into the machine and returning the tied group to the original position. This action is accomplished by adding the necessary components to a machine that has already been designed.

While this manual tie-down station approach functions ideally in small laundries its operational characteristics additionally include the potential of eliminating injuries to workers since it is not necessary to lift large bundles of garments on the hangers for tying, instead the hangers are simply manually slid across a recessed slide rod and the operator presses the foot switch which draws the selected group into the machine and returns to the original position after a two second delay, where the bundled clothing are removed or may continue along a conveyer.

Since an operator is required for the above previously filed manual tie-down station the primary object of the instant invention, which is a continuation-in-part, is to make the entire operation automatic eliminating even the necessity of an operator at the tying station. In order to accomplish this desired automatic feature, the improvement is used in conjunction with an automated conveyer system that sorts the garments and uses gravity to feed the group of hangers containing laundered clothing directly to the invention which interrupts the flow. The conveyer system electrical controls initiate a signal which starts the process, replacing the previously used foot switch, drawing the intercepted group of hangers into the tie-out station which functions to tie the hangers together with a twist tie. When the process is completed a second signal from the conveyer system electrical controls releases the grouped hangers using an intercept yoke lever permitting them to continue by gravity on the conveyer. In order to maintain the gravity flow it is necessary that the entire tie-out station is mounted on the same angle as the conveyer. It should be noted however that this angular disposition has no effect on the tying machines operational capabilities in any way.

Angularly mounting the invention is easily accomplished as conventional C-clamps or angled tubes may be attached to the two support rods extending from the bottom of the tie-out station using support pipes connected to overhead support beams in the customary manner.

Still another inventive object still employs the use of an original twist tie machine that is well known in the art and has been marketed in this country for decades. This object is particularly advantageous in that the basic tying apparatus is well proven and the addition of the equipment to alter the machine into a tie-out station is easy to accomplish and cost effective. This modification to an existing tying machine is simply accomplished with minimal parts replacement and modification.

Yet another object of the invention is that the pneumatic system requirements for the tie-out station modification are well within conventional pressures and flow rates that are currently available in most cleaning facilities within this country.

In order to provide conveyer systems that utilize either an outside hook hanger configuration or an inside hook hanger configuration the invention may be manufactured to satisfy the users existing conveyer system in either requirement. The invention provides a technique that with minor variations in components of the hanger slide shaft assembly the selection becomes a matter of choice and during the assembly procedure the selected style is easily accommodated.

A final object is the additional inclusion of a binding stop safety circuit interconnected with the tying machine electrical system which operates in the event that the hangers become tangled and bind. If this occurs the tying machine's electrical system shuts down its functional capabilities until the tangle or bind is manually cleared.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 32 is a partial isometric view of the inside hook hanger slide shaft assembly, shown completely removed from the invention for clarity.

FIG. 33 is an exploded isometric view of the hanger interceptor sub-assembly, shown completely removed from the invention for clarity.

FIG. 34 is a partial isometric view of the inside hook guide plate, shown completely removed from the invention for clarity.

FIG. 35 is a partial isometric view of the inside hook shaft upper support plate, shown completely removed from the invention for clarity.

FIG. 36 is a partial isometric view of the inside hook guide connector plate, shown completely removed from the invention for clarity.

FIG. 37 is a partial isometric view of the inside hook shaft upper support plate, shown completely removed from the invention for clarity.

FIG. 38 is a partial isometric view of the inside hook shaft lower support plate, shown completely removed from the invention for clarity.

FIG. 39 is a partial isometric view of the slide shaft spacer bar, shown completely removed from the invention for clarity.

FIG. 40 is a partial isometric view of the tying machine switch activating arm, shown completely removed from the invention for clarity.

FIG. 41 is a partial isometric view of the hanger slide shaft, shown completely removed from the invention for clarity.

BEST MADE FOR CARRYING OUT THE INVENTION

The best mode for carrying out the invention for an automatic laundry tie-out station is presented in terms of a preferred embodiment. It will be noted that the element designations for the previously filed manual laundry tie-out station will remain the same and the improvements to make the invention automatic will begin with the designation starting with the 200 series.

Figure 1:
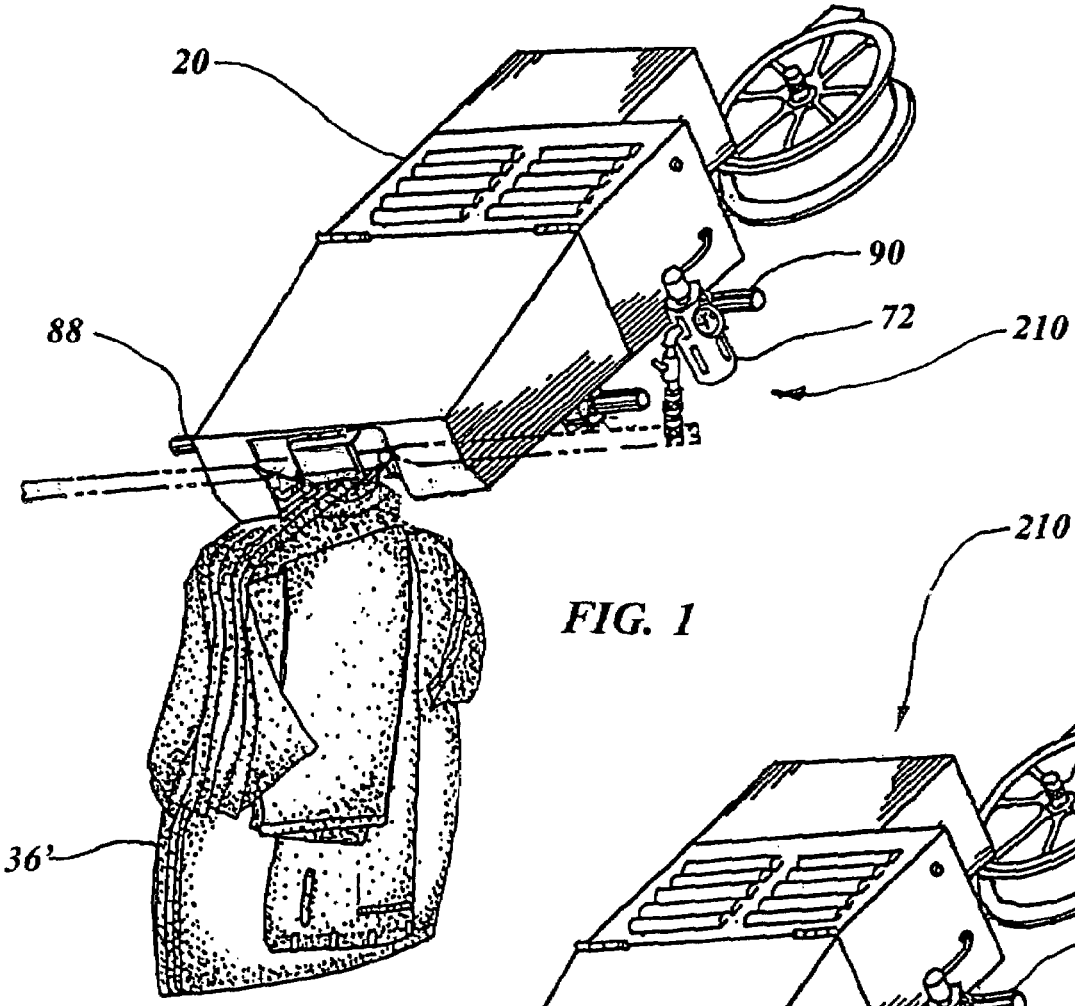
FIG. 1 is a partial isometric view of the preferred embodiment with a group of laundered shirts on hangers resting on the hanger slide shaft.

The preferred embodiment is shown in FIGS. 1 thorough 53 and is comprised of an automatic laundry tie-out station 210 that employs a tying machine 20 that has been improved to include components that expand its ability to incorporate the functional capabilities of an automatic laundry tie-out station. The tying machine 20 preferably utilized is of the type having means for twist-tying articles, with an adjustable opening to receive the articles to be tied within the opening, means for adjusting the opening to control the metered length of a twist-tie ribbon for tying objects of various sizes, and means for adjusting the opening of the machine for centering objects of various sizes to be tied, in addition the tying machine must of necessity have a component mounting platform integral therewith.

Figure 52:
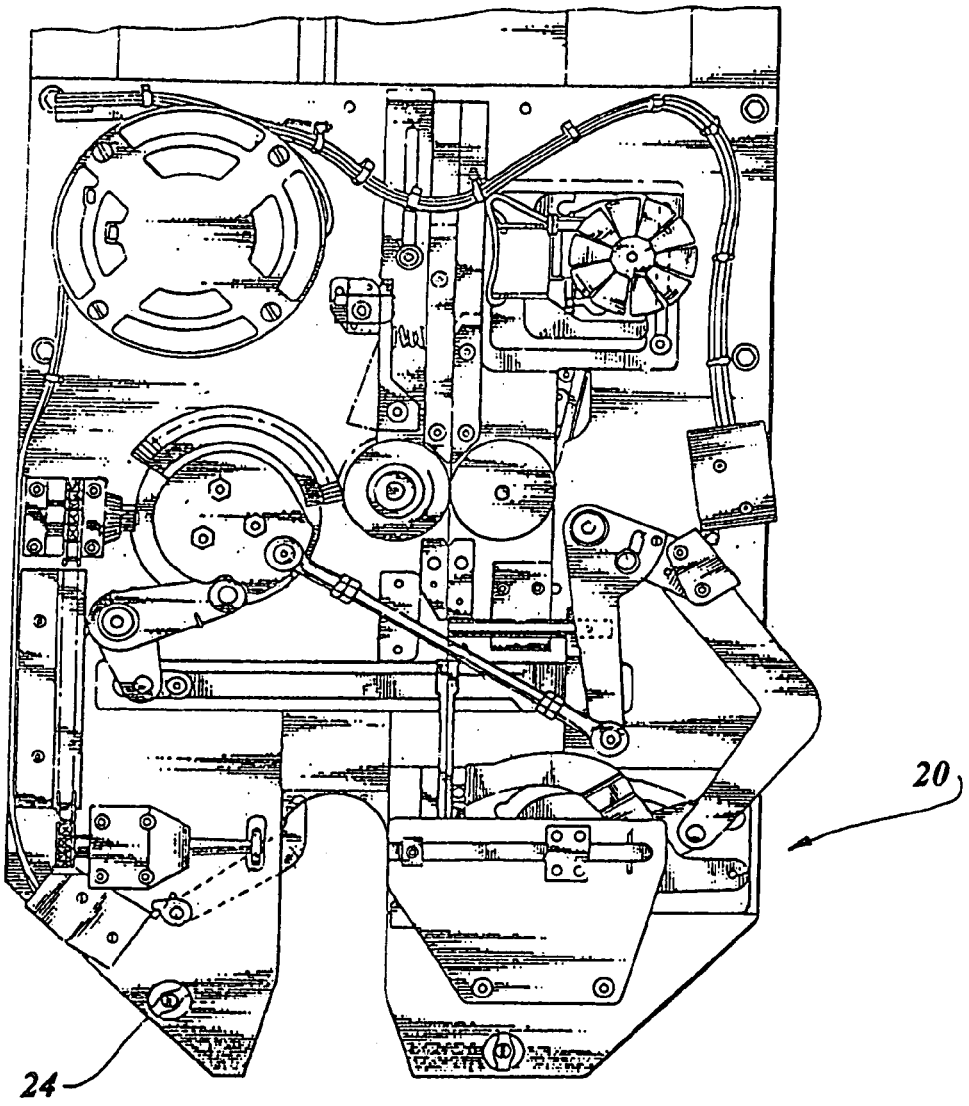
FIG. 52 PRIOR ART
FIG. 52 is a plan view of the existing prior art tying machine component mounting platform as illustrated in the prior art patent drawings.
Figure 53:
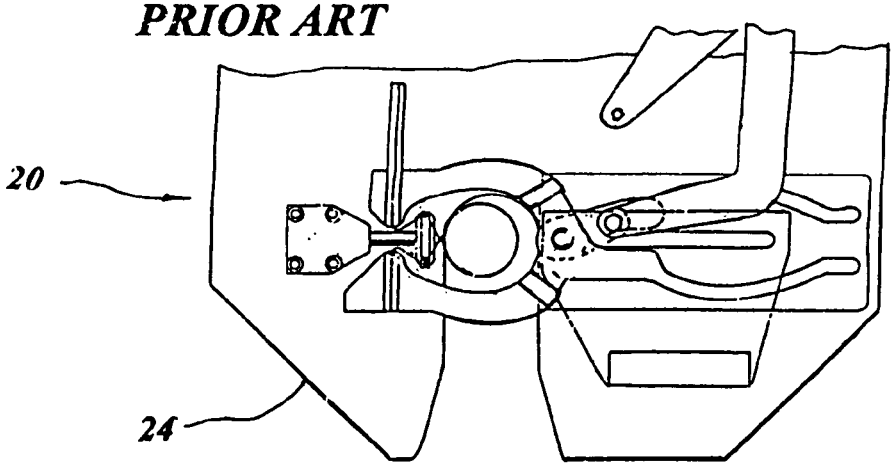
FIG. 53 PRIOR ART
FIG. 53 is a plan view of the existing prior art tying machine tying forming scissors moved to the fully extended position at the tying station with a twist tie article positioned at the tying station.

While the components required are specific to a particular tying machine the same approach may be made to alter almost any machine made for bag-in-box and flow-through operations. The precise tying machine 20 to which the invention is presently directed, is the Model XL-2 so called "Tie-Matic" heavy duty model manufactured by PLAS-TIES of Tustin Calif. which was protected by U.S. Pat. No. 4,054,160 issued on Oct. 18, 1977. Obviously some updating has been accomplished in the years since the patent was originally issued however the basic criteria of the patent still apply. FIGS. 52 and 53 illustrate the prior art tying machine's component mounting platform 24 along with the appropriate components as it was originally patented.

Figure 10:
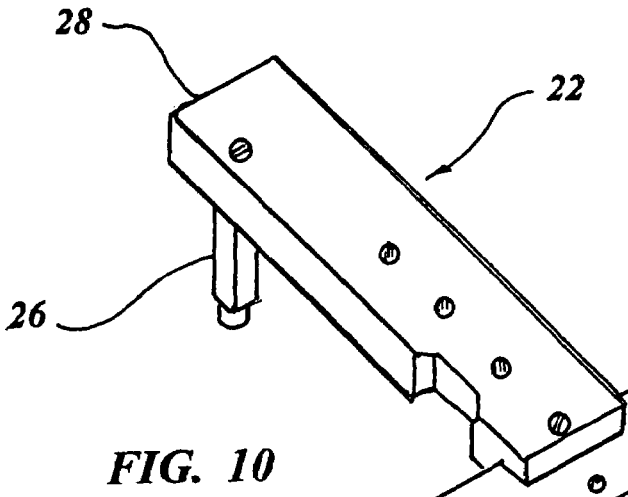
FIG. 10 is a partial isometric view of the liner slide support yoke frame assembly, shown completely removed from the improvement for clarity.
Figure 11:
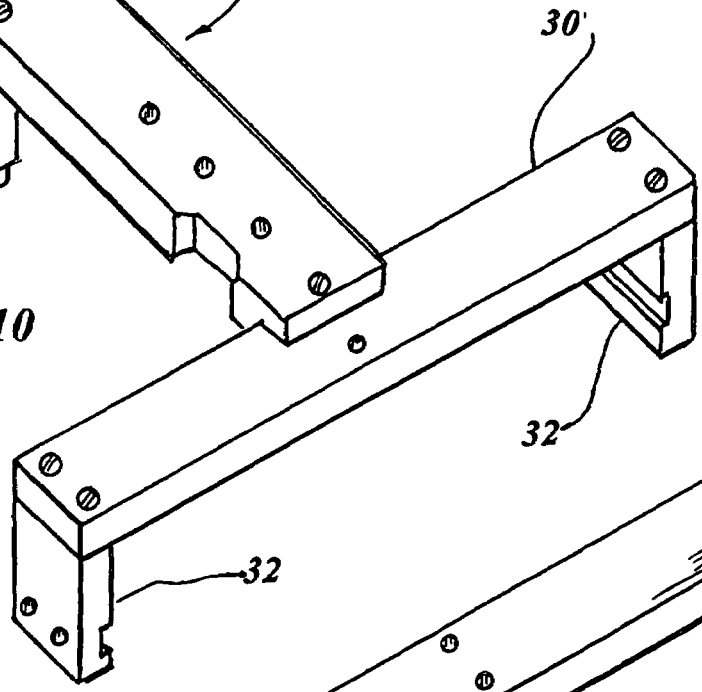
FIG. 11 is a partial isometric view of the support column, shown completely removed from the invention for clarity.
Figure 11:
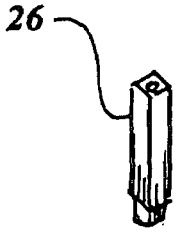
Figure 13:
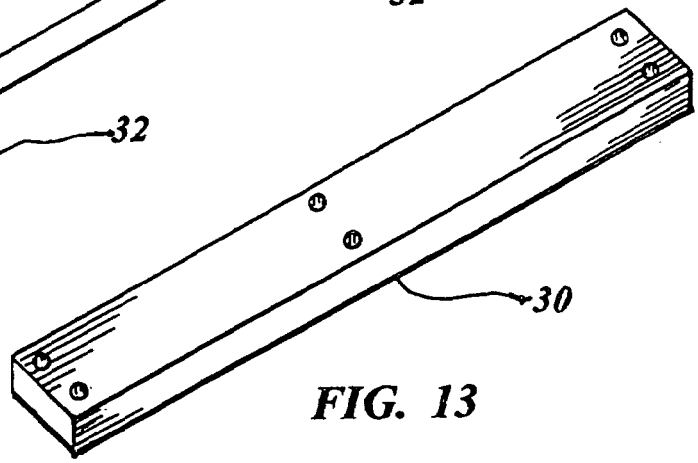
FIG. 13 is a partial isometric view of the cross member plate, shown completely removed from the invention for clarity.
Figure 12:
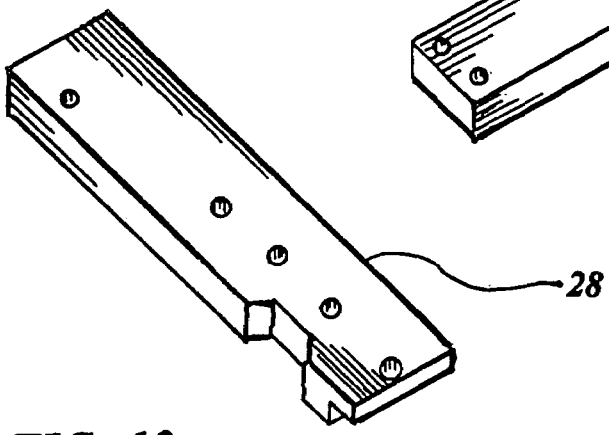
FIG. 12 is a partial isometric view of the linear slide mounting plate, shown completely removed from the invention for clarity.
Figure 15:
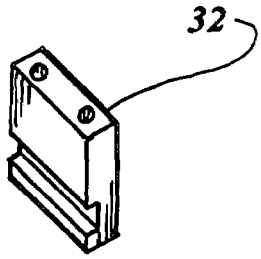
FIG. 15 is a partial isometric view of the right side support plate, shown completely removed from the invention for clarity.
Figure 14:
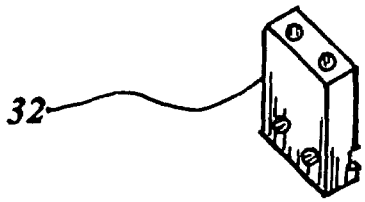
FIG. 14 is a partial isometric view of the left side support plate, shown completely removed from the invention for clarity.

The components added to the existing tying machine 20 include a linear slide support yoke frame 22 that is attached on top of the tying machine component mounting platform 24. The support yoke frame 22 is illustrated by itself in FIG. 10 with its components shown individually in FIGS. 11–15 and installed on the platform 24 in FIGS. 5 and 7. The support yoke frame 22 consists of a support column 26 that is attached to the component mounting platform 24 in alignment with the platform throat near the back edge. A linear slide mounting plate 28 rests on the support column 26 on one end and a cross member plate 30 is connected to the slide mounting plate 28. A pair of identical opposed side support plates 32 interface with adjoining sides of the cross member plate 30 on the top and attach to the sides of the component mounting platform 24 on the bottom, providing a suitable raised surface for mounting a pneumatic linear slide unit 34. It will be noted that the support yoke frame 22 serves two purposes, first it raises the slide unit 34 above the existing mechanism for achieving the twist tie operation and second it locates clothing hangers 36 that are grouped to be tied in the proper vertical position.

It should also be understood that the construction techniques illustrated are not to be construed as being the only type of structure that may be used, as formed sheet metal, castings or any other fabrication method may be employed with equal ease.

The pneumatic linear slide unit 34, disposed on the linear slide support yoke frame 22, draws a selected group of hangers 36 into the tying machine 20 as noted above. The linear slide unit 34 is preferably the double acting piston type with hydraulic shock absorbers providing end position cushioning. While other types of pneumatic equipment may be used, the slide unit 34 is ideal as it has a mounting face that is convenient for attachment purposes and it further has an integral slide member that remains on the same plane regardless of its position. The ancillary shock absorbing capabilities are useful to cushion the piston travel when retracting the selected group of hangers 36. Travel from the fully extended position to the retracted position is smooth and may be adjusted in speed to provide an even movement so as to not jolt the combined hangers 36 from the surface upon which they are resting.

Due to the fact that the conveyer systems sometimes use the hangers 36 either with the hook facing outside or the hook facing inside therefore the automatic laundry tie-out station 210 includes two separate configurations of a hanger slide shaft assembly which are basically the same but allow the hangers 36 to face a specific direction.

Figure 26:
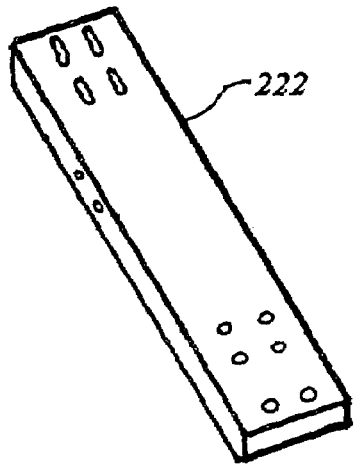
FIG. 26 is a partial isometric view of the outside hook shaft upper support plate, shown completely removed from the invention for clarity.
Figure 27:
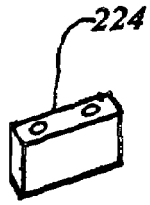
FIG. 27 is a partial isometric view of the shaft support connector plate, shown completely removed from the invention for clarity.
Figure 28:
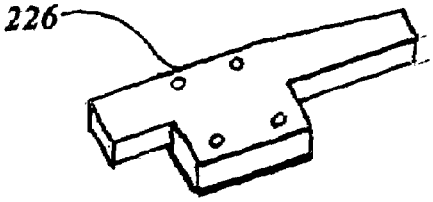
FIG. 28 is a partial isometric view of the outside hook shaft lower support plate, shown completely removed from the invention for clarity.
Figure 29:
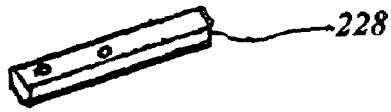
FIG. 29 is a partial isometric view of the slide shaft spacer bar, shown completely removed from the invention for clarity.
Figure 30:
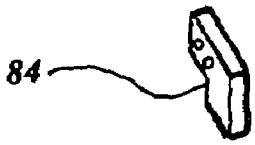
FIG. 30 is a partial isometric view of the tying machine switch activating arm, shown completely removed from the invention for clarity.
Figure 31:
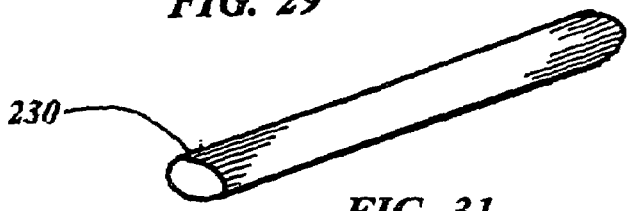
FIG. 31 is a partial isometric view of the hanger slide shaft, shown completely removed from the invention for clarity.
Figure 42:
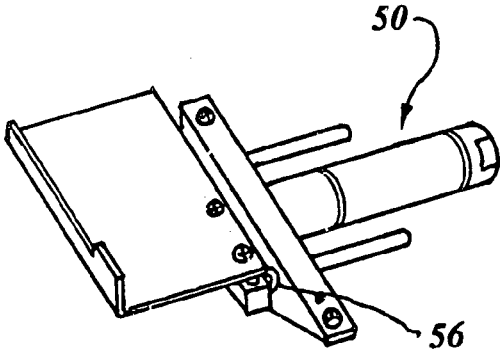
FIG. 42 is a partial isometric view of the hanger nesting actuator, shown completely removed from the invention for clarity.
Figure 43:
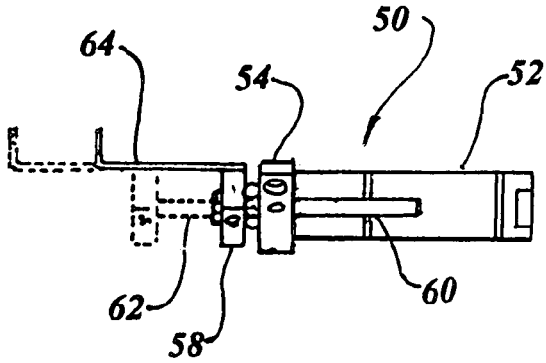
FIG. 43 is a side elevation view of the hanger nesting actuator, shown completely removed from the invention for clarity.
Figure 44:
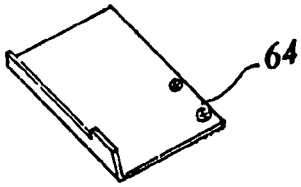
FIG. 44 is a partial isometric view of the hanger bunching angle bracket, shown completely removed from the invention for clarity.
Figure 45:
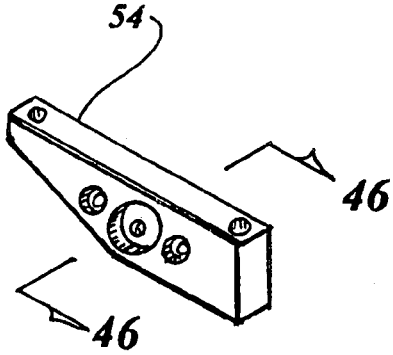
FIG. 45 is a partial isometric view of the cylinder mounting base, shown completely removed from the invention for clarity.
Figure 46:
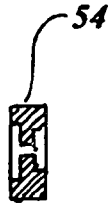
FIG. 46 is a cross sectional view taken along lines 46—46 of FIG. 45.
Figure 47:
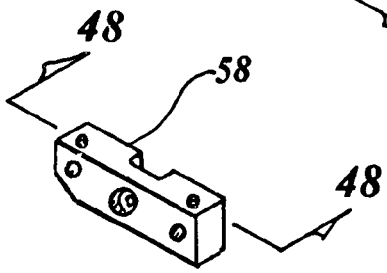
FIG. 47 is a partial isometric view of the ram mounting plate, shown completely removed from the invention for clarity.
Figure 48:
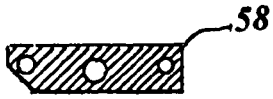
FIG. 48 is a cross sectional view taken along lines 48—48 of FIG. 47.
Figure 49:
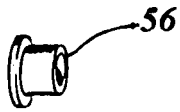
FIG. 49 is a partial isometric view of self-lubricating bushings, shown completely removed from the invention for clarity.
Figure 50:
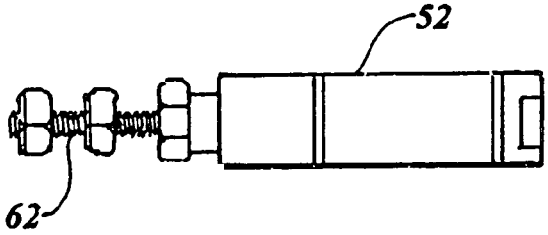
FIG. 50 is a side elevation view of the hanger nesting actuator pneumatic cylinder, shown completely removed from the invention for clarity.
Figure 51:
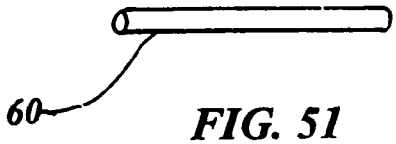
FIG. 51 is a partial isometric view of one of the ram stabilizing arms, shown completely removed from the invention for clarity.

The outside hook hanger slide shaft assembly 220 with its separate components are illustrated in FIGS. 24–31 and consists of a outside hook shaft upper support plate 222, shown alone in FIG. 26, rigidly connected on the top of the linear slide unit 34. A shaft support connector plate 224 is attached to the outside hook shaft upper support plate 222 and a outside hook shaft lower support plate 226 attached to the shaft support connector plate 224 forming an C shaped angle bracket with the elements illustrated in FIGS. 26–28. A slide shaft spacer bar 228 contiguously engages the outside hook shaft lower support plate 226 and a slide shaft 230 attached to a top surface of the slide shaft spacer bar 228.

The inside hook hanger slide shaft assembly 220*a* with its separate components are illustrated in FIGS. 32–41 and consists of a inside hook shaft upper support plate 222*a*, shown alone in FIG. 37, rigidly connected on the top of the linear slide unit 34. The same shaft support connector plate 224 is attached to the inside hook shaft upper support plate 222*a* and a inside hook shaft lower support plate 226*a* is attached to the shaft support connector plate 224 and the elements are illustrated in FIGS. 35, 37 and 38. The same slide shaft spacer bar 228 contiguously engages the inside hook shaft lower support plate 224*b* and the same slide shaft 230 is attached to a top surface of the slide shaft spacer bar 228. An inside hook guide connector plate 224*a* is attached to the inside hook shaft upper support plate 222*a* forming an C shaped angle bracket. The remainder of the components for the inside hook hanger slide shaft assembly 220*a* are identical and described in detail above.

A hanger interceptor sub-assembly 232 is attached to either the inside hook shaft upper support plate 222 or outside hook shaft upper support plate 222*a* for blocking the selected group of hangers with clothing 36' on the gravity conveyer system and releasing them after tying. The hanger interceptor subassembly 232 is shown attached to the hanger slide shaft assembly 220 and 220*a* in FIGS. 24 and 32 and exploded into its individual components in FIGS. 25 and 33. The hanger interceptor sub-assembly 232 consists of a bifurcated intercept lever cylinder base 234, which is stepped in height into three levels, with the distal end having a pair of yoke brackets 236 attached thereunto. The opposite bifurcated end includes a pair of lever pivot portions 238 of the cylinder bases 234 opposite each of the forks. An intercept yoke lever 240 is pivotally attached between the lever pivot portions 238 and held in place with a pivot pin 242. The intercept yoke lever 240 is shaped to incorporate a radial indentation that matches with the outside diameter of the slide shaft 230 in order to stabilize the hangers 36 during feeding into and out of the tying machine 20. A double acting pneumatic intercept cylinder 244 is pivotally mounted between the yoke brackets 236 and onto the intercept yoke lever 240. The pneumatic intercept cylinder 244 returns the intercept lever 240 to a position that interrupts the hangers on the gravity conveyer system when energized.

A switch actuating arm 84 is attached to the side of the shaft upper support plate 222 and functions to energize the hanger nesting actuator switch 83 to nest the hanger's together ready for tying.

It is also understood that the construction techniques illustrated in FIGS. 26–29 and 34–39 are not necessarily the only type of structure that may be used, as formed sheet metal, castings or any other fabrication methods may be employed with equal ease.

Figure 7:
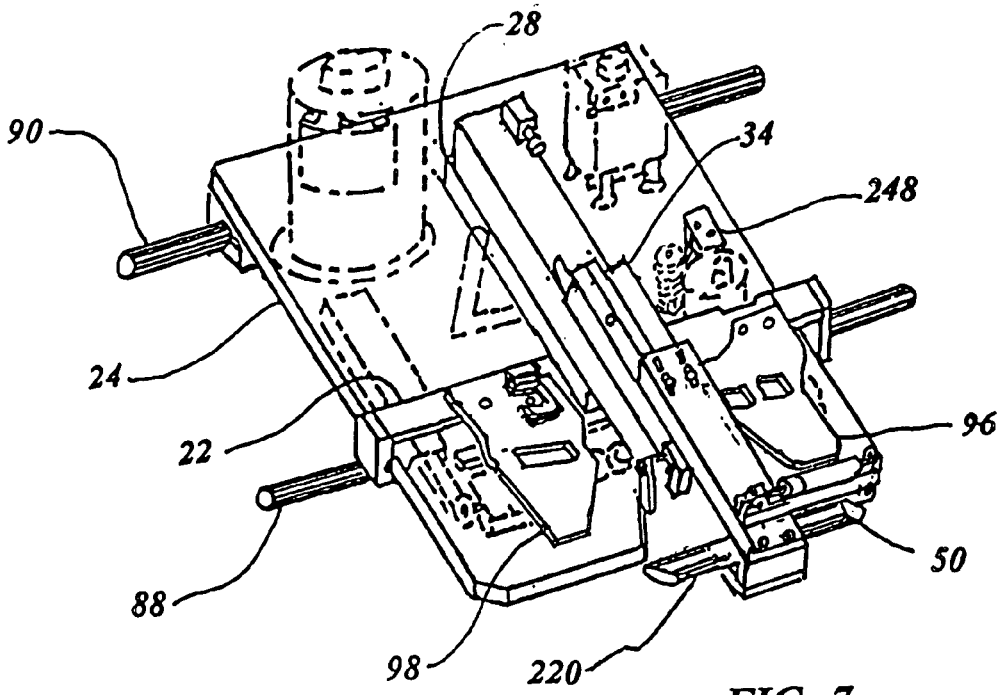
FIG. 7 is a fragmentary partial isometric view of the tying machine component mounting platform including the slide support yoke with the linear slide unit attached on top and the relevant elements mounted thereon.
Figure 8:
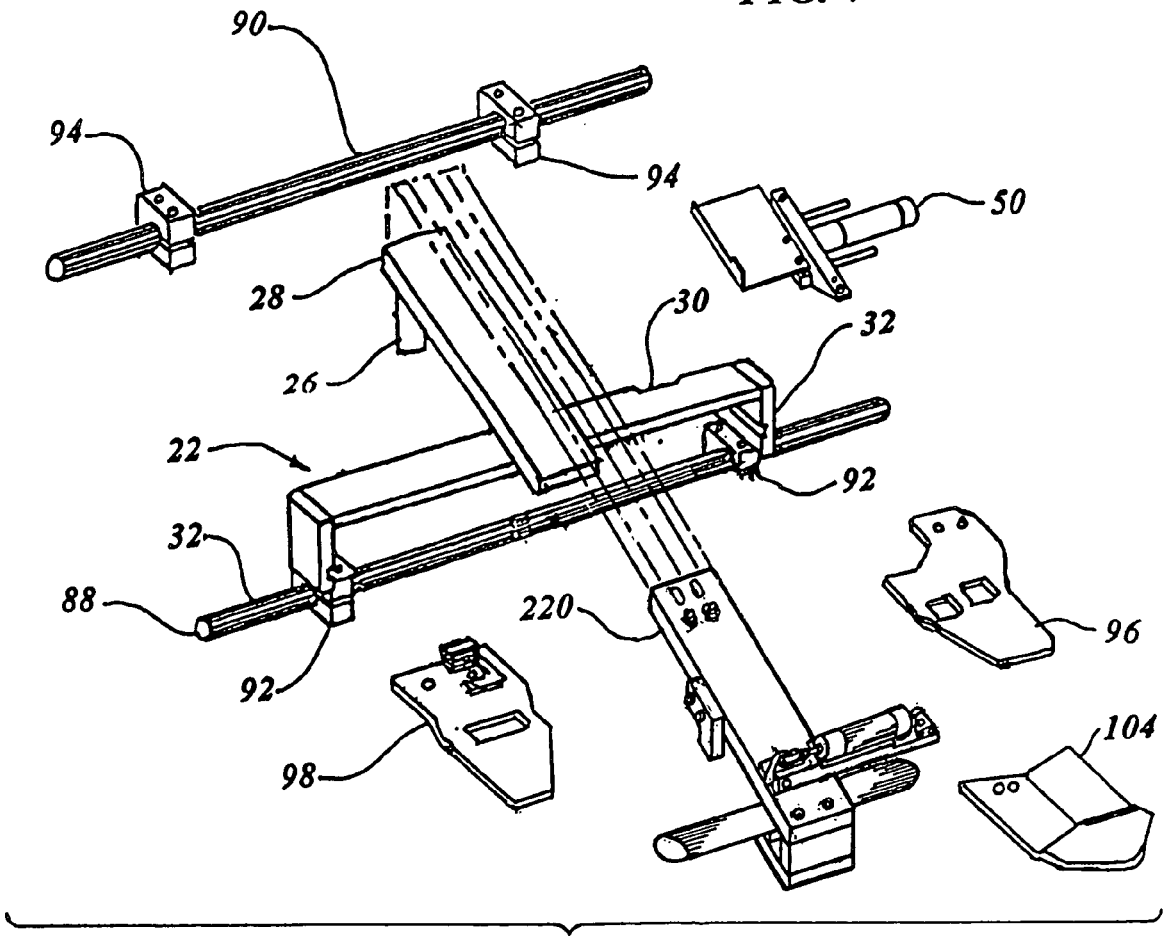
FIG. 8 is an exploded view of the mounting elements that attach the linear slide unit to the tying machines component mounting platform along with relevant elements.

A hanger nesting actuator 50 is mounted under the component mounting platform 24 as shown in FIGS. 7 and 8. The hanger nesting actuator 50 is optionally employed for bunching the selected group of hangers with laundered clothing 36' together permitting the tying machine 20 to tightly bind the hangers 36 with a twist tie and release the hangers 36 permitting the hanger slide shaft 230 to return the bound hangers 36 to the original position after the tying is completed.

As shown in FIGS. 42–51 the hanger nesting actuator 50 preferably consists of a pneumatic cylinder 52 with a cylinder mounting base 54 connected on one end, with the cylinder mounting base 54 including a pair of self-lubricating bushings 56. The cylinder mounting base 54 is configured to attach the pneumatic cylinder 52 under the tying machine component mounting platform 24 with conventional threaded fasteners or the like. A ram mounting plate 58, having an opposed pair of ram stabilizing arms 60 extend therefrom, permits stabilization of the pneumatic cylinder's integral ram 62. A bunching angle bracket 64 is connected on an upper surface of the ram mounting plate 58 with the stabilizing arms 60 penetrating the cylinder mounting base self-lubricating bushings 56. When the cylinder 52 is pneumatically actuated the ram 62 forces the bunching angle bracket 64 into contact with the selected group of hangers 36 compressing them together permitting the tying machine 20 to bind the hangers 36 tightly together with a twist tie.

Figure 9:
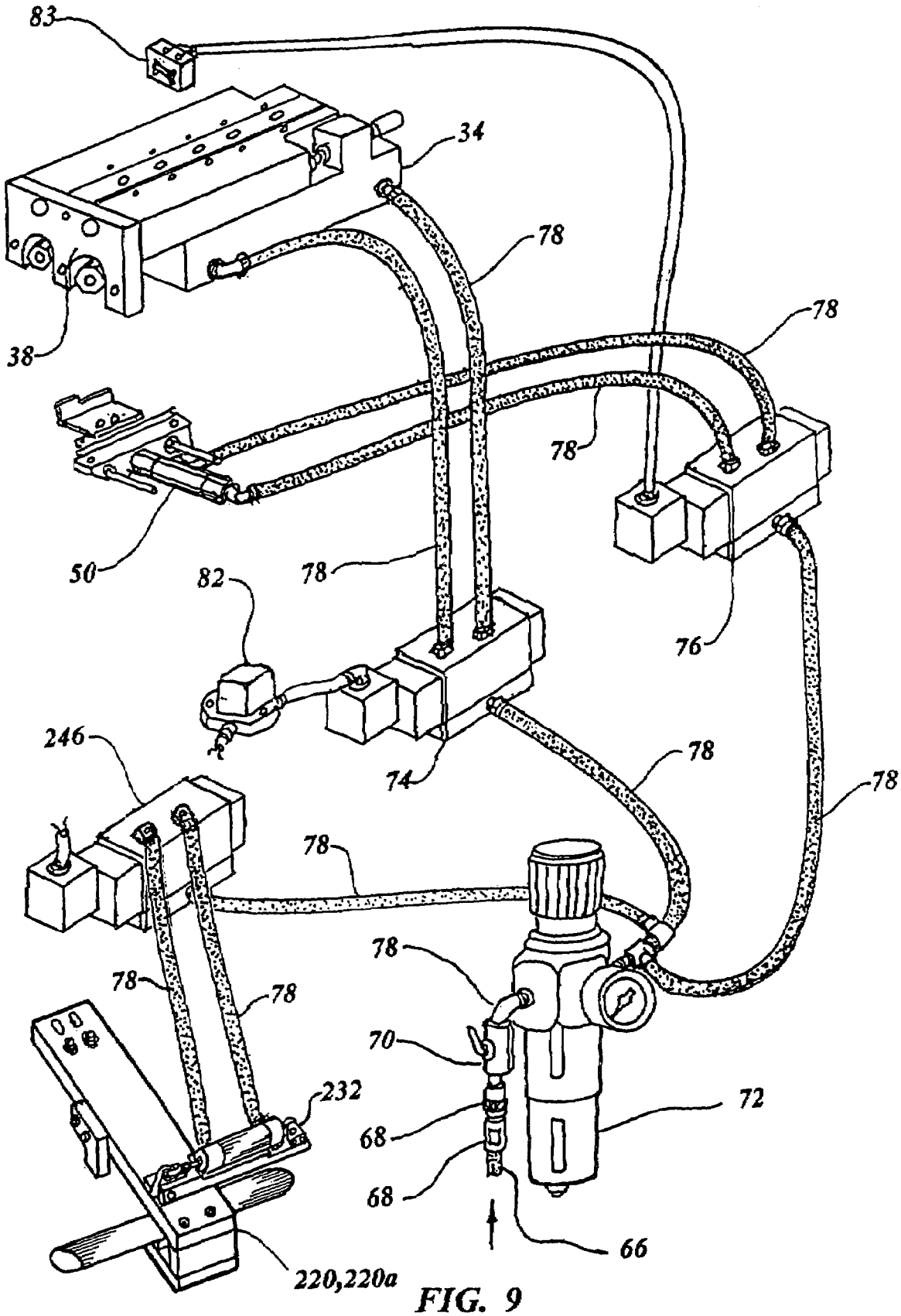
FIG. 9 is a partial pictorial schematic isometric view of the pneumatic system including electrical components for actuating the automatic laundry tie-out station.

A pneumatic system provides the power to actuate the linear slide unit 34 permitting the hanger slide shaft assembly 220 or 220*a* to be drawn into the tying machine 20 and urged back to an original position. The preferred pneumatic system is illustrated in FIG. 9 and consists of a pneumatic hose 66 for connecting to a compressed air source, a pneumatic quick connect hose coupling 68 attached to the hose 66 and pneumatic ball valve 70 connected to the coupling 68. A filter regulator 72 is in communication with the ball valve 70 on one side and a linear slide unit valve 74 on the other with the valve 74 controlling the action of the linear slide unit 34. The valve 74 introduces compressed air into one side of the linear slide unit cylinder to drive the slide unit cylinder piston into the retracted position permitting the hangers 36 to be attached together with a twist tie from the tying machine 20. The two position valve 74 relieves pressure from the driven side and introduces pressure to the opposite side of the piston to return the hanger slide shaft assembly 220 or 220*a* to the original blocking position.

The filter regulator 72 is simultaneously in communication with a hanger nesting actuator valve 76 controlling the movement of the hanger nesting actuator 50 which forces the bunching angle bracket 64 into contact with the selected group of hangers 36 permitting the tying machine 20 to bind the hangers 36 tightly together with a twist tie as described previously. An intercept cylinder valve 246 is in communication with the outlet side of the filter regulator and energizes the intercept cylinder 244 when it receives a signal from the conveyer system. Obviously other fittings and interconnecting pneumatic tubing 78 are required as illustrated in FIG. 9 to complete the system.

The pneumatic system utilizes standard pressures for operation such as 30 to 120 pounds per square inch (2 to 8 bar) 150 pounds per square inch (10 bar) maximum. The location of the hydraulic system is optional as the valves 74, 78 and 246 along with their ancillary equipment may be installed at any convenient location. There are many other schemes and combination of components that would function in the same manner and therefore the invention is not necessarily limited to the approach described and shown.

While a pneumatic system is ideal and preferred for the application other electrical or electro-mechanical systems may be used with equal ease such as ball screw drives, motor driven rack and pinion gears, electro-magnetic solenoids, linear motors and a host of others.

Means for integrally controlling the tying machine 20 consists of the following actions; actuating the pneumatic system from a first remote electrical signal, bunching the selected group of hangers together, returning the hanger slide shaft 230 into alignment with the gravity laundry conveyer system after the tying machine 20 has electromechanically completed binding the selected group of hangers together with the twist tie and releasing the intercept lever 240 with a second remote electrical signal permitting the selected bound group of hangers to continue on the gravity conveyer system.

Control of the tying machine 20 is specifically explained as the first remote electrical signal from the conveyer system is connected to a first time delay relay 82 which is electrically connected to the pneumatic linear slide unit valve 74 such that when the first remote electrical signal is received the pneumatic linear slide unit valve 74 energizes the linear slide unit 34 bringing the selected group of hangers into contact with the tying machine 20 placing the twist tie ribbon around the selected group of hangers. After the first time delay relay 82 has timed out, the linear slide unit 34 returns to its original position aligning the hanger slide shaft 230 with the gravity laundry conveyer system.

The control function further includes a hanger nesting actuator switch 83, located above the cross member plate 30, is energized by a switch activating arm 84 positioned on the side of the linear slide unit 34. When the pneumatic linear slide unit 34 draws the selected group of hangers 36 into the tying machine the hanger nesting actuator switch 83 energizes the hanger nesting actuator valve 76 permitting the hanger nesting actuator 50 to urge the hangers 36 together sufficiently to allow the tying machine 20 to twist a tie ribbon around the hangers 36 and then returns to its normal retracted position.

Figure 5:
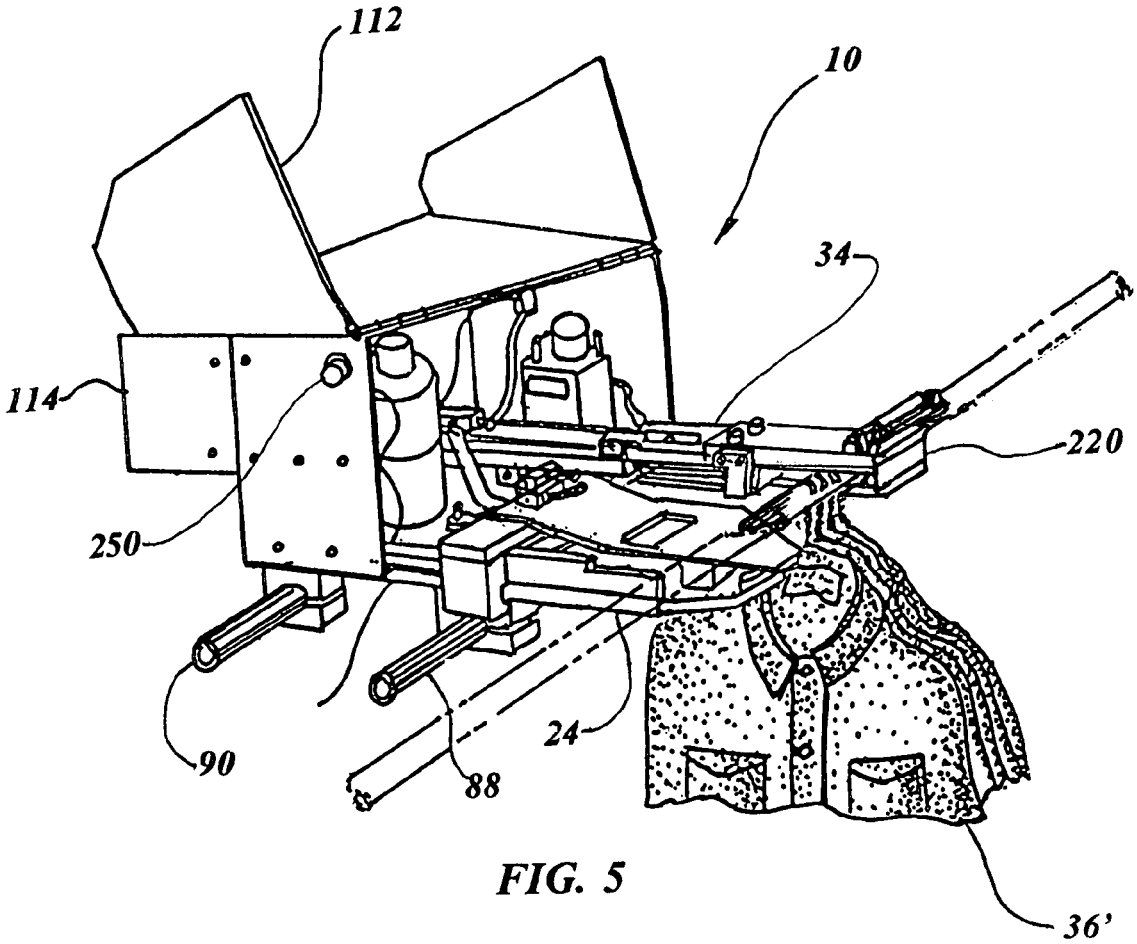
FIG. 5 is a partial isometric view of the preferred embodiment with the front cover opened illustrating the mechanism inside and a portion of a conveyer system shown in phantom.
Figure 6:
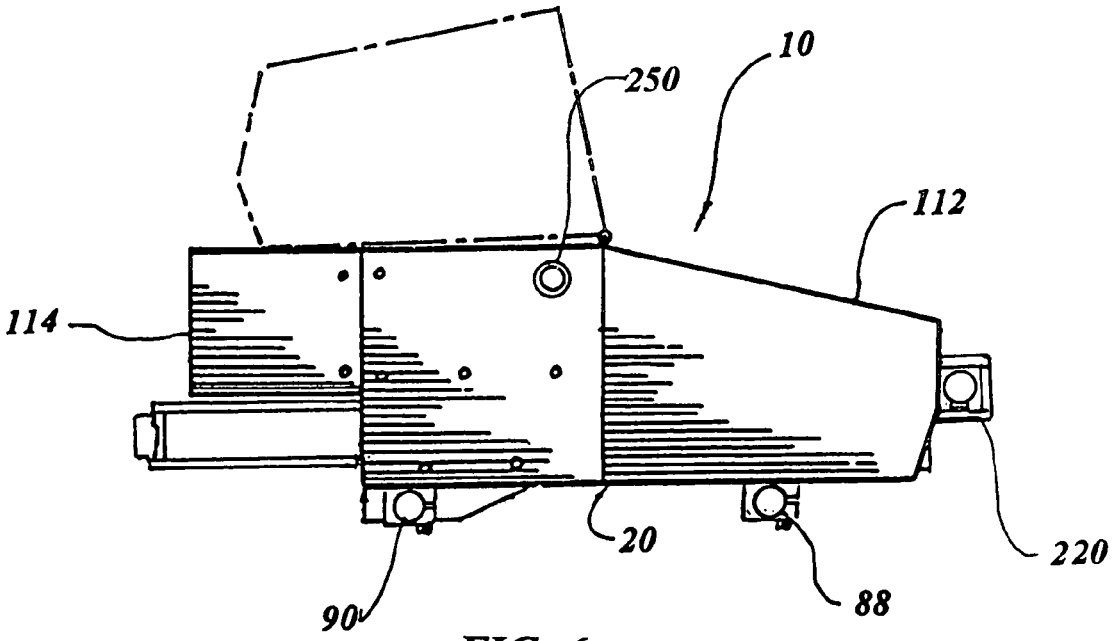
FIG. 6 is a side elevation view of the tying machine with the control box relocated and the front cover closed and the linear slide unit in the extended position. The front cover is also depicted in the open position in phantom.

A binding stop safety switch 248 and a reset button switch 250 are positioned on the tying machine 20 and interconnected with the tying machine electrical system such that if the selected group of hangers 36 become tangled and bind while entering into the tying machine 20 the electrical system shuts down until the tangle or bind is manually cleared and the reset switch 250 is energized permitting continuing normal operation. The location of the binding stop safety switch 248 and a reset button switch 250 are illustrated in FIGS. 5–7.

Figure 3:
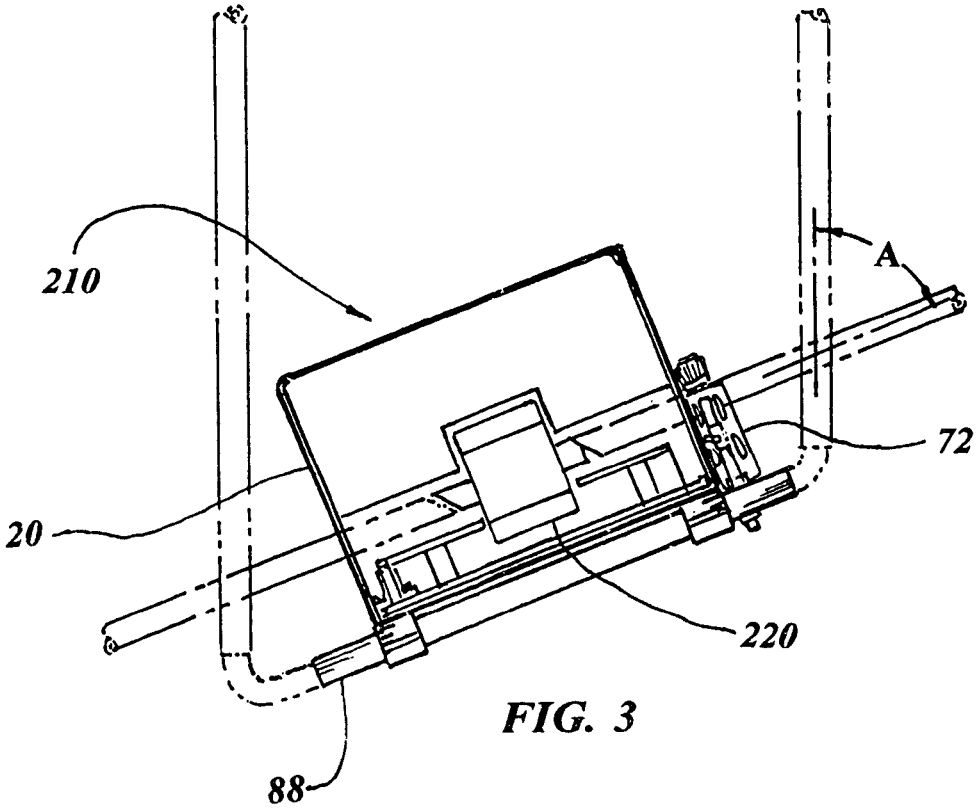
FIG. 3 is a front view of the preferred embodiment of the automatic tying station in its mounted angular position with a portion of the conveyer system and the supports shown in phantom lines as they are not part of the invention.
Figure 16:
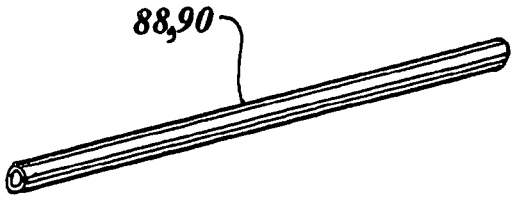
FIG. 16 is a partial isometric view of one of the support rods, shown completely removed from the invention for clarity.
Figure 18:
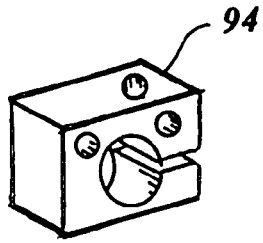
FIG. 18 is a partial isometric view of one of the rear support rod brackets, shown completely removed from the invention for clarity.
Figure 17:
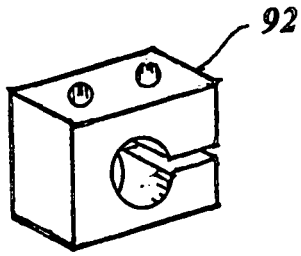
FIG. 17 is a partial isometric view of one of front support rod brackets, shown completely removed from the invention for clarity.

The automatic laundry tie-out station 210 is to be used with a laundry conveyer system, therefore the station 210 incorporates a front support rod 88 and a rear support rod 90 attached under the tying machine 20 for mounting at an angle to conventional building support beams. The front support rod 88 is preferably connected to the bottom of the tying machine 20 with a pair of front support rod brackets 92 and the rear support rod 90 is connected with similar rear support rod brackets 94. The rods 88 and 90 are shown as one in FIG. 16, as they are identical, and likewise the support rod brackets 92 and 94 are illustrated as one in FIGS. 17 and 18 respectively although they are each configured right hand and left hand in mirror image. As the conveyer system utilizes gravity to slide the hangers into the automatic laundry tie-out station 210 it is necessary to mount the station 210 at an angle to be in alignment with the existing conveyer system. The angle to match the gravity laundry conveyer system consists of an angle from vertical of from 15 degrees to 45 degrees as illustrated in FIG. 3 designated with the letter "A".

It will be noted that even though the rods 88 and 90 are best suited for hanging on conveyer systems, legs may be easily added to the extending ends with EMT tee's or similar pipe fittings with equal ease and dispatch.

Figure 19:
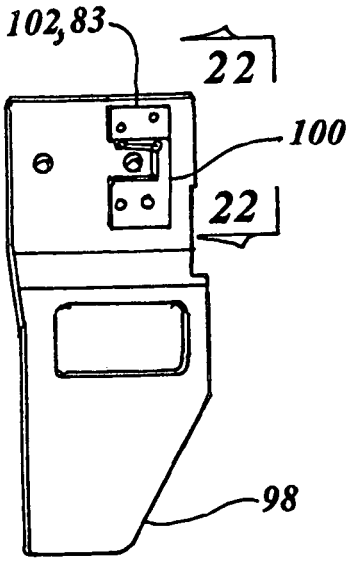
FIG. 19 is a partial isometric view of the left upper guide plate assembly, shown completely removed from the invention for clarity.
Figure 20:
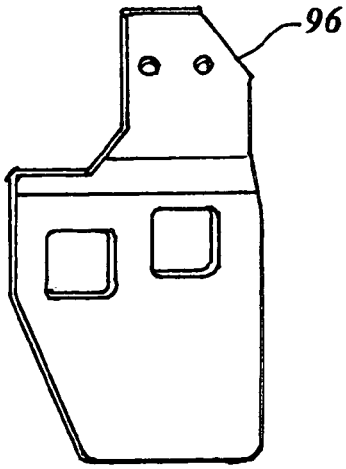
FIG. 20 is a partial isometric view of the right upper guide plate, shown completely removed from the invention for clarity.

In order to assure reliability, smoothly configured covers or guides are added to the tying machine 20 at the appropriate locations to isolate protruding elements. A right upper guide plate 96 is attached to the right top side of the linear slide support yoke frame 22 and a left upper guide plate 98 is attached to the left top side of the same linear slide support yoke frame 22. The shape and form of the plates 96 and 98 and their position over the component mounting platform 24 preclude contact with existing elements that are mounted on the upper surface. It will be noted that the left upper guide plate 98 contains a separate switch mounting plate 100 configured to orient the hanger nesting actuator switch 83 along with a relocated tying machine integral control switch 102 at the proper functional location. FIGS. 5, 6 and 7 illustrate the mounting location of the plates 96 and 98 with FIGS. 19 and 20 showing the detail of each plate 96 and 98.

Figure 21:
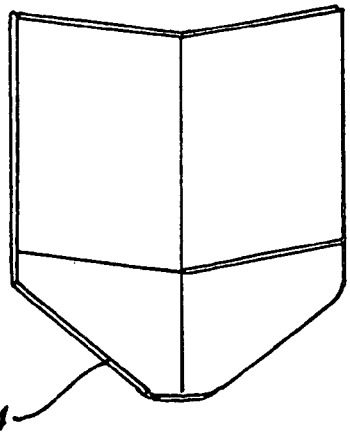
FIG. 21 is a partial isometric view of the hanger nesting actuator shield, shown completely removed from the invention for clarity.
Figure 22:
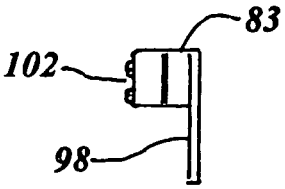
FIG. 22 is a side view taken looking onto the edge of FIG. 19 illustrating the left upper guide plate, switch mounting bracket, hanger nesting actuator switch, and the tying machine actuating switch.
Figure 23:
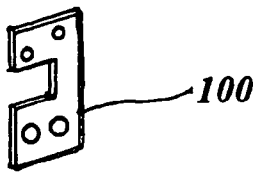
FIG. 23 is a partial isometric view of the switch mounting bracket, shown completely removed from the invention for clarity.
Figure 24:
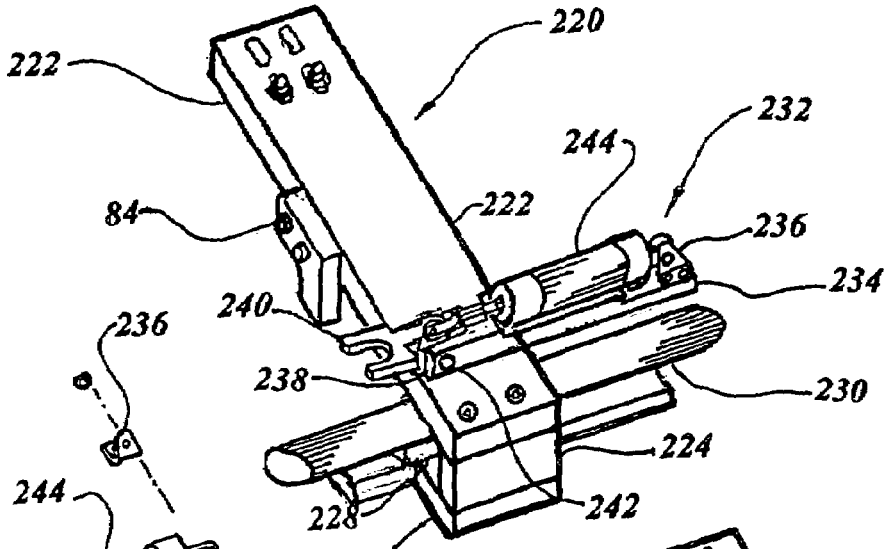
FIG. 24 is a partial isometric view of the outside hook hanger slide shaft assembly, shown completely removed from the invention for clarity.
Figure 25:
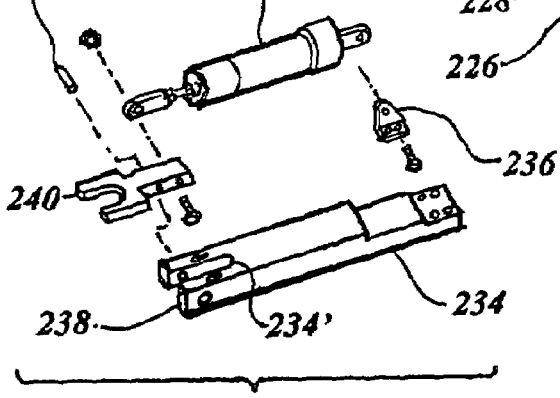
FIG. 25 is an exploded isometric view of the hanger interceptor sub-assembly, shown completely removed from the invention for clarity.

A hanger nesting actuator shield 104 is attached beneath the tying machine component mounting platform 24 to preclude contact with elements mounted thereon. The shield 104 is illustrated alone in FIG. 21 and in its approximate location in FIG. 8.

Figure 2:
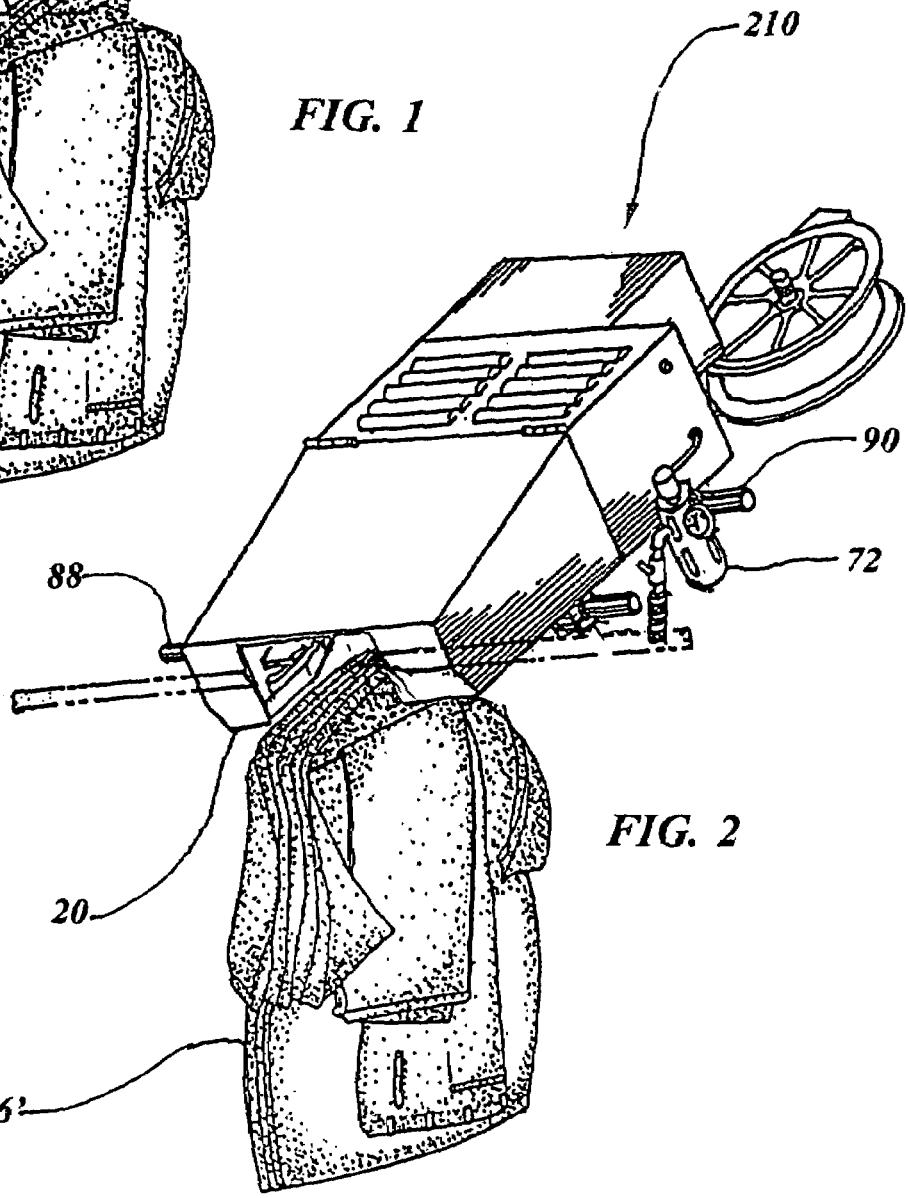
FIG. 2 is a partial isometric view of the preferred embodiment with a group of laundered shirts on hangers after being drawn into the tying machine and coupled together with a twist tie.
Figure 4:
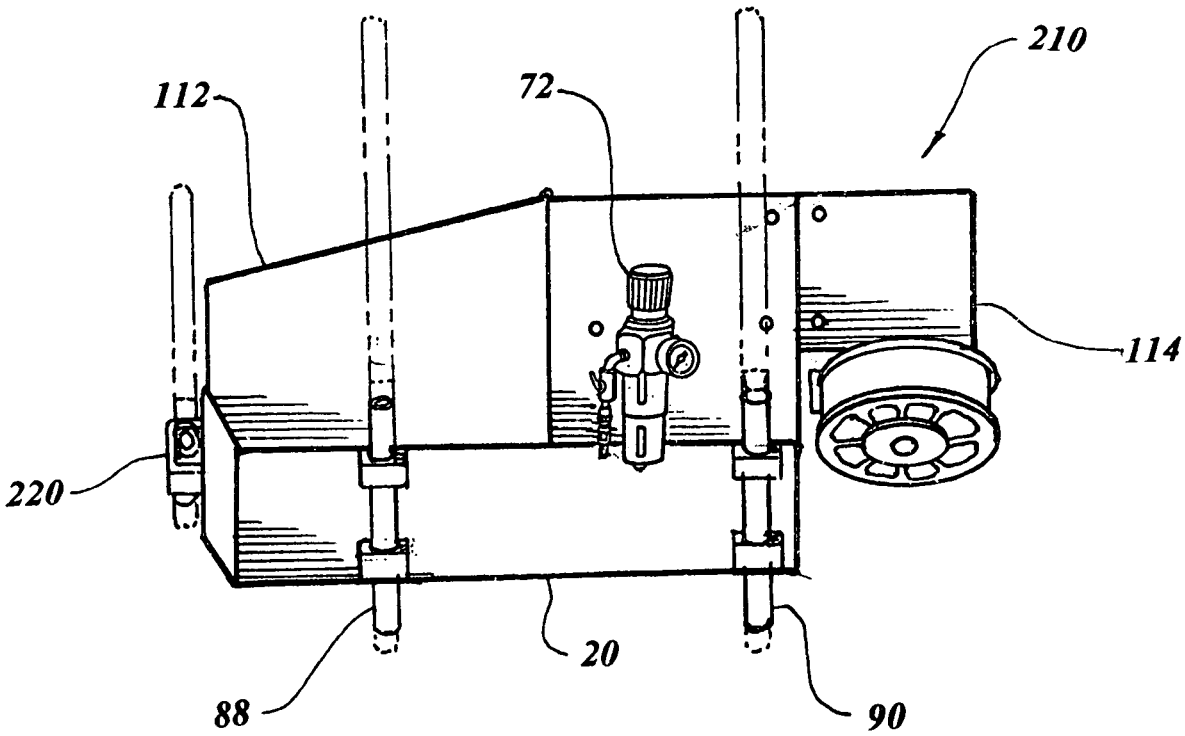
FIG. 4 is a a is a side view of the preferred embodiment of the automatic tying station with a portion of the conveyer system and the supports shown in phantom lines.

Slight modifications to the tying machine 20 are required in the form of replacements or additions along with relocation of components to complete its transformation to an automatic tie-out station 210. A replacement front cover 112 and a rear cover 114 are required to allow sufficient space to house the addition of the laundry tie-out station improvements. The covers 112 and 114 are basically the same shape except slightly larger and the rear cover 114 includes a plurality of louvers 116 on a top surface to provide air circulation within the tying machine 20. The tying machine's control box 118 is relocated to the rear instead of on top and is attached to a rear portion of the replacement rear cover 114. In order to provide room for the relocated control box 118, means are required to mount the roll of twist tie wire 120 in a horizontal position as illustrated in FIGS. 1, 2 and 4 however the roll of twist tie wire 120 may also be mounted vertically with equal ease.

In operation, pneumatic pressure is attached to the quick connect hose coupling 68. A selected group of hangers 36 containing laundered garments 36' that have been previously sorted are slid by gravity to the center front of the tying machine 20 and rest on the hanger slide shaft 230. When a first remote signal is received to the first time delay relay 82 the selected group of hangers 36 containing laundered clothing 36' are drawn into the tying machine 20 where it automatically bundles the hangers 36 with a twist tie and in two seconds returns the tied group to the original position where a second remote signal is received actuating the pneumatic intercept cylinder 244 which pivots the yoke lever 240 from engagement with the hangers 36 allowing the hangers 36 to continue their travel along the conveyer system.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An automatic laundry tie-out station which comprises, a tying machine for binding a selected group of hangers together with a twist tie, a linear slide unit mounted on the tying machine for automatically drawing the selected group of hangers into the tying machine, and a hanger slide shaft and a hanger intercept lever are attached to the linear slide unit for supporting the selected group of hangers, permitting the tying machine to bind the hangers with the twist tie with the hanger slide shaft returning the bound hangers into alignment with a laundry gravity conveyer system after the tying is completed.

2. An automatic laundry tie-out station which comprises, a tying machine for binding a selected group of hangers together with a twist tie, a linear slide unit mounted on a linear slide support yoke frame connected to the tying machine for drawing the selected group of hangers positioned on a gravity laundry conveyer system into the tying machine, a hanger slide shaft assembly and a hanger interceptor sub assembly are attached to the linear slide unit for retaining and supporting the selected group of hangers, with a hanger slide shaft aligned with the gravity laundry conveyer system, and a hanger nesting actuator mounted on the tying machine for bunching the selected group of hangers together permitting the tying machine to tightly bind the hangers with the twist tie and return the bound hangers into alignment with the gravity laundry conveyer system after the tying is completed.

3. An automatic laundry tie-out station that incorporates a tying machine of the type having means for tying articles with a twist-tie said tying machine having an adjustable opening to receive articles to be tied within the opening, means for adjusting the opening to control the metered length of a twist-tie ribbon for tying objects of various sizes and means for adjusting the opening of the machine for centering objects of various sizes to be tied, in addition said tying machine specifically having a component mounting platform integral therewith, wherein additional elements convert the tying machine into the laundry tie-out station, which comprises, a linear slide support yoke frame attached on top of the tying machine component mounting platform, a pneumatic linear slide unit, with said slide unit disposed on the linear slide support yoke frame, for drawing a selected group of hangers containing laundered clothing suspended thereupon into the tying machine, a hanger slide shaft assembly, having a pneumatic controlled intercept lever, with the hanger slide shaft assembly attached to the pneumatic linear slide unit, aligned with a gravity laundry conveyer system for retaining the selected group of hangers, a pneumatic system connected to the linear slide unit for actuating said linear slide unit drawing the slide shaft assembly into the tying machine and urging return of a slide shaft of the slide shaft assembly into alignment with the gravity laundry conveyer system, and means for integrally controlling the tying machine including actuating said pneumatic system from a first remote electrical signal bunching the selected group of hangers together, returning the hanger slide shaft into alignment with the gravity laundry conveyer system after the tying machine has electromechanically completed binding the selected group of hangers together with the twist tie and releasing the intercept lever with a second remote electrical signal permitting the selected bound group of hangers to continue on the gravity conveyer system.

4. The automatic laundry tie-out station as recited in claim 3 wherein said linear slide support yoke frame further comprises, a support column abutting and attached to the tying machine component mounting platform, a linear slide mounting plate resting on the support column, a cross member plate connected to the slide mounting plate and a pair of side support plates interfacing with sides of the cross member plate and each side of the tying machine component mounting platform providing a suitable raised surface for mounting the pneumatic linear slide unit.

5. The automatic laundry tie-out station as recited in claim 3 wherein said pneumatic linear slide unit further comprises, a double acting piston with hydraulic shock absorbers providing end position cushioning.

6. The automatic laundry tie-out station as recited in claim 3 wherein said hanger slide shaft assembly further comprises, a shaft upper support plate rigidly connected to said linear slide unit, a shaft support plate connector attached to the a shaft upper support plate a shaft lower support plate attached to the shaft support plate connector, a slide shaft spacer bar contiguously engaging the shaft lower support plate and the slide shaft attached to a top surface of the slide shaft spacer bar, a hanger interceptor sub-assembly attached to the shaft upper support plate for blocking the selected group of hangers on the gravity conveyer system and releasing after tying.

7. The automatic laundry tie-out station as recited in claim 6 wherein said hanger interceptor sub-assembly further comprises, an intercept lever cylinder base attached to a top surface of the shaft support plate, a pair of yoke brackets attached to the intercept lever cylinder base on one end and a pair of lever pivot portions of the cylinder base on the opposite end with the intercept lever pivotally attached to the lever pivot portions of the cylinder base, and a double acting intercept cylinder positioned therebetween for pneumatically actuating the intercept lever blocking and releasing the selected group of hangers on the gravity conveyer system.

8. The automatic laundry tie-out station as recited in claim 3 further comprising a hanger nesting actuator for bunching the selected group of hangers together permitting the tying machine to bind the selected group of hangers securely together with the twist tie.

9. The automatic laundry tie-out station as recited in claim 8 wherein said hanger nesting actuator further comprises, a pneumatic cylinder having a cylinder mounting base thereon which includes a pair of self-lubricating bushings with the cylinder mounting base configured to attach the pneumatic cylinder under the tying machine component mounting platform, a ram mounting plate having an opposed pair of stabilizing arms extending therefrom attached to a ram of the pneumatic cylinder also a bunching angle bracket connected on an upper surface of the ram mounting plate with the stabilizing arms penetrating the cylinder mounting base self-lubricating bushings such that when the cylinder is actuated by the pneumatic system the ram forces the bunching angle bracket into contact compressing the selected group of hangers together permitting the tying machine to bind the selected group of hangers tightly together with the twist tie.

10. The automatic laundry tie-out station as recited in claim 9 wherein said pneumatic system further comprises, a pneumatic hose for connection to a compressed air source, a pneumatic quick connect hose coupling attached to the pneumatic hose, a pneumatic ball valve connected to the quick connect hose coupling, a filter regulator in communication with the pneumatic ball valve, a pneumatic linear slide unit valve interfacing with the filter regulator controlling movement of the linear slide unit, and simultaneously said filter regulator interfacing with the hanger nesting actuator valve thereby controlling the movement of the hanger nesting actuator forcing the bunching angle bracket into contact with the selected group of hangers together permitting the tying machine to bind the hangers tightly together with the twist tie.

11. The automatic laundry tie-out station as recited in claim 3 wherein said means for integrally controlling the tying machine further comprises, said first remote electrical signal connected to a first time delay relay with the first time delay relay electrically connected to the pneumatic linear slide unit valve such that when the first remote electrical signal is received the pneumatic linear slide unit valve energizes the linear slide unit bringing the selected group of hangers into contact with the tying machine placing the twist tie ribbon around the selected group of hangers and, after the first time delay relay has timed out, the linear slide unit returns to its original position aligning the hanger slide shaft with the gravity laundry conveyer system.

12. The automatic laundry tie-out station as recited in claim 8 further comprising, a hanger nesting actuator switch and a hanger nesting actuator valve such that when the pneumatic linear slide unit draws the selected group of hangers into the tying machine the hanger nesting actuator switch energizes the hanger nesting actuator valve permitting the hanger nesting actuator to urge the hangers together allowing the tying machine to twist the tie ribbon around the selected group of hangers and, return to an at rest position.

13. The automatic laundry tie-out station as recited in claim 3 further comprising a front support rod and a rear support rod attached under the tying machine for mounting the laundry tie-out station to building support beams.

14. The automatic laundry tie-out station as recited in claim 3 further comprising a right upper guide plate attached to the linear slide support yoke frame and a left upper guide plate attached to the linear slide support yoke frame for guiding the recessed hanger slide rod over the tying machine component mounting platform to preclude contact with elements mounted thereon.

15. The automatic laundry tie-out station as recited in claim 9 further comprising a hanger nesting actuator shield attached under the tying machine component mounting platform to preclude contact with elements mounted thereon.

16. The automatic laundry tie-out station as recited in claim 3 further comprising a binding stop safety switch and a reset button switch positioned onto the tying machine and interconnected with the tying machine electrical system such that if the selected group of hangers become tangled and bind while entering into the tying machine the electrical system shuts down until the tangle or bind is manually cleared and the reset switch is energized continuing normal operation of the tying machine.

17. The automatic laundry tie-out station as recited in claim 3 further comprising a tying machine integral control switch and a hanger nesting switch disposed above the linear slide support yoke frame electrical control of the tying machine and the tie-out station sequential function.

18. The automatic laundry tie-out station as recited in claim 3 further comprising a replacement front cover on the tying machine allowing space to house the addition of the laundry tie-out station improvement and a replacement rear cover on the tying machine allowing space to house the addition of the laundry tie-out station improvement, said rear cover having a plurality of louvers on a top surface to provide air circulation within the tying machine.

19. The automatic laundry tie-out station as recited in claim 18 further comprising a relocated control box attached to a rear portion of the replacement rear cover and means to mount a roll of twist tie wire.

20. The automatic laundry tie-out station as recited in claim 3 wherein said automatic laundry tie-out station is mounted in alignment with the gravity laundry conveyer system at an angle from vertical of from 15 degrees to 45 degrees.

* * * * *